US005783028A

United States Patent [19]

Kunimoto

[11] Patent Number: 5,783,028

[45] Date of Patent: Jul. 21, 1998

[54] SHEET SPLICING APPARATUS

[75] Inventor: Masanori Kunimoto, Kani, Japan

[73] Assignee: ISOWA Hooperswift, Ltd., Kasugai, Japan

[21] Appl. No.: 566,684

[22] Filed: Dec. 4, 1995

[51] Int. Cl.[6] ..... B65H 21/00

[52] U.S. Cl. ..... 156/504; 156/502; 156/157; 242/552; 242/553; 242/556.1

[58] Field of Search ..... 156/157, 159, 156/502, 504, 505; 242/551, 552, 553, 556.1

[56] References Cited

U.S. PATENT DOCUMENTS

| | | | |
|---|---|---|---|
| 3,749,622 | 7/1973 | Sato et al. | 156/502 X |
| 4,001,067 | 1/1977 | Johnson | 156/504 X |
| 4,487,645 | 12/1984 | Weston | 156/157 |
| 4,564,184 | 1/1986 | Rumpel | 156/502 X |
| 4,668,328 | 5/1987 | Kyytsonen | 156/502 |
| 4,946,551 | 8/1990 | Ishige et al. | 156/563 X |
| 5,468,321 | 11/1995 | Van Liempt et al. | 156/505 X |
| 5,639,338 | 6/1997 | Beckamnn | 156/504 |

*Primary Examiner*—Mark A. Osele
*Attorney, Agent, or Firm*—Ronald R. Snider

[57] ABSTRACT

In the sheet splicing apparatus 1, a sheet holding bar 28*b* (28*a*) is arranged along the width of the end potion of the sheet 26 from the secondary roll 24. The end portion of the sheet 26 is removably attached to the sheet holding bar 28*b* (28*a*), which moves between a position P for attaching the end portion of the sheet and a position Q for splicing it to the sheet 12 from the primary roll 10. On the sheet holding bar 28*b* (28*a*), a plurality of holding pins 58 are removably mounted spaced along the width of the sheet 26. These holding pins 58 hold the sheet by piercing through the sheet 26 in the thickness direction thereof and have a sheet stopping portion 70*b* for preventing the sheet 26 dropping off the holding pins 58.

16 Claims, 14 Drawing Sheets

FIG. 10A
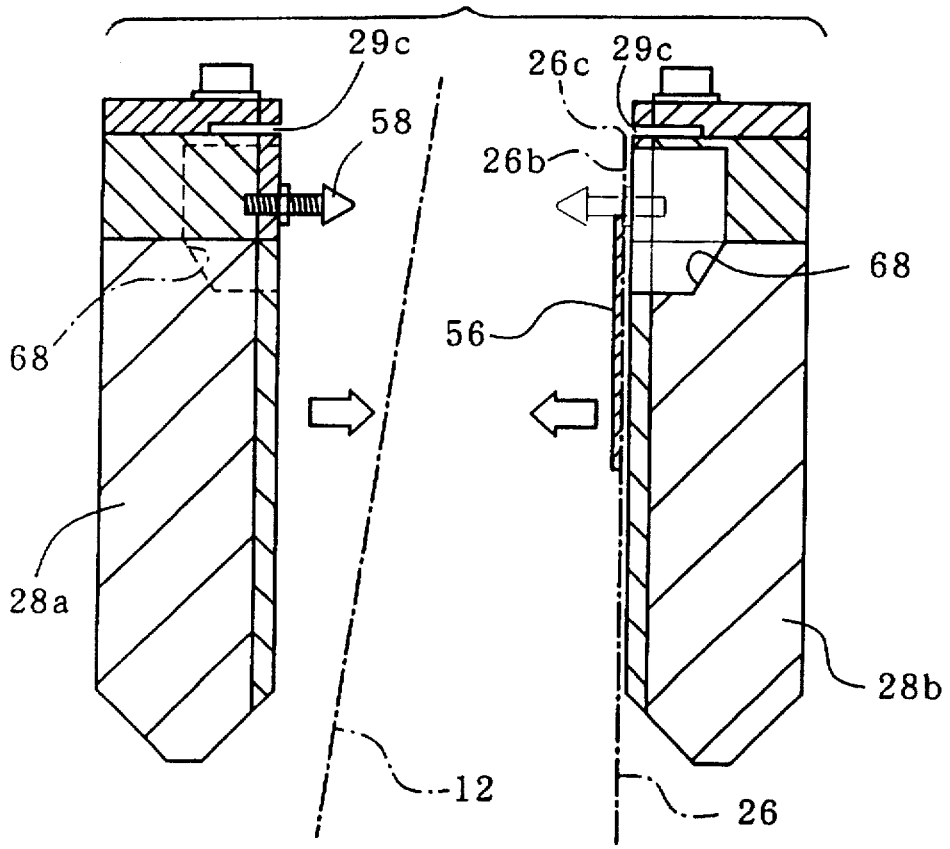
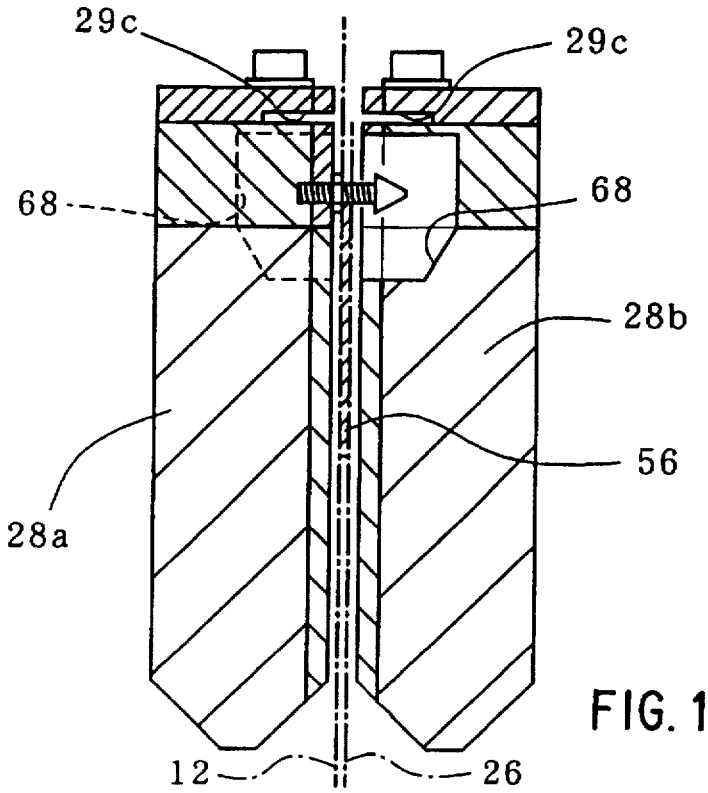
FIG. 10B

FIG. 12A
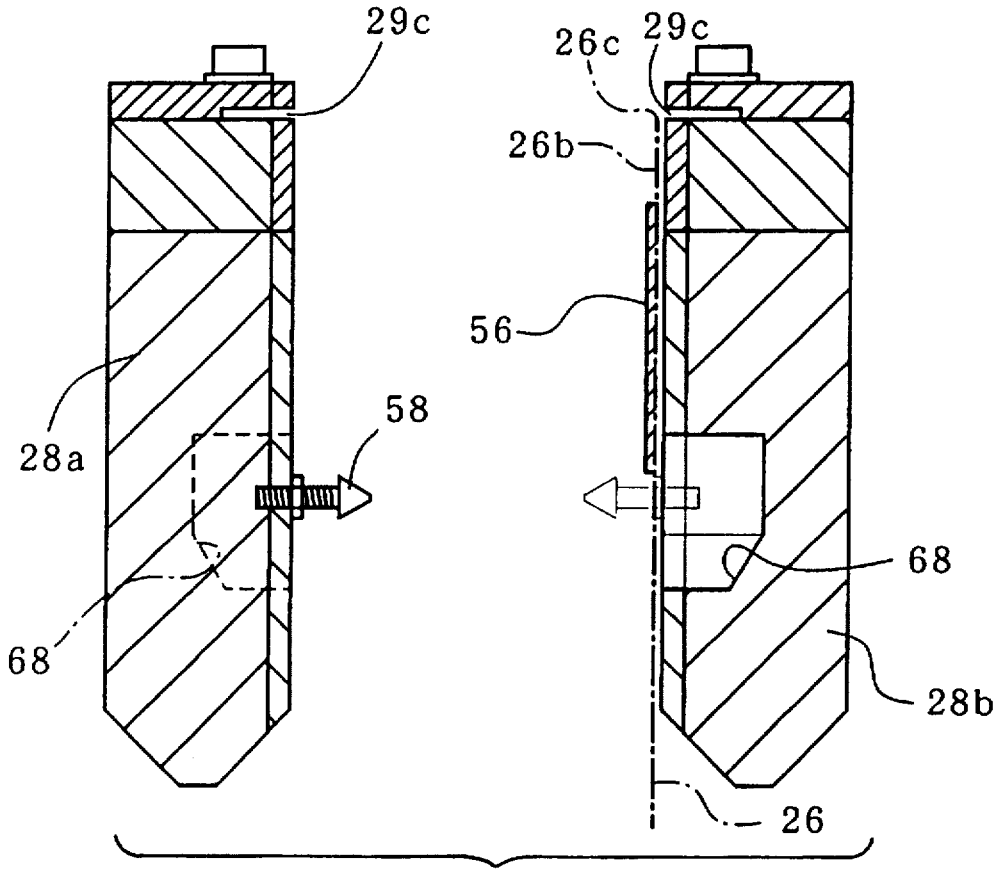
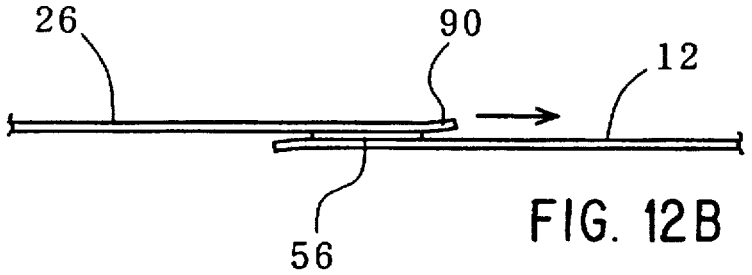
FIG. 12B
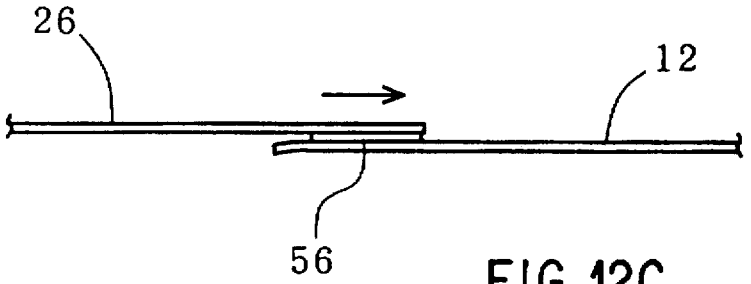
FIG. 12C

SHEET SPLICING APPARATUS

FIELD OF INVENTION

This invention relates to a sheet splicing apparatus used preferably for a corrugated board manufacturing line or a printing line and so on.

BACKGROUND OF INVENTION

In a line for corrugated board manufacturing or printing, a raw sheet such as paper is continuously fed to the line from a roll in a sheet feeder. In many cases, a sheet splicing apparatus has been used for splicing a sheet from a new roll to a sheet from an old roll and maintaining the continuity of line operation.

As shown in FIG. 15, one of conventional types of sheet splicing apparatus 100 has a pair of splicing head 101 each of which moves between a sheet setting position P and a sheet splicing position Q along head guides 102, respectively. Splicing heads 101 have nipping bars 103 which move to and away from each other by means of air cylinders 104 when each splicing head is located in the splicing position Q.

As shown in FIG. 16, each nipping bar 103 has a suction mechanism 105, respectively, and as shown in FIG. 15, the end portion of the sheet 106 from the new roll R2 is attached to the nipping bar 103 by means of said suction mechanism 105 in the setting position P. Then, the splicing head 101 is moved to the splicing position Q with the attached sheet 106, and two splicing heads 101 clip the sheet 106 and the sheet 107 from the old roll R1 therebetween, whereby splicing the sheets 106 and 107 with a double-faced adhesive tape T.

Such type of splicing apparatus, however, has following disadvantages.

(1) In the process of the splicing head 101 moving from the setting position P to the splicing position Q, the end portion of the sheet 106 sometimes drops off from the nipping bar 103 due to insufficiency of the suction force by the suction mechanism 105. That is to say, the reliability of setting a new sheet to the apparatus is not very high.

(2) The inner mechanism of the nipping bar 103 becomes very complicated since said suction mechanism 105 should be assembled therein, thereby causing an increase in the cost of the apparatus.

The object of this invention is to offer a sheet splicing apparatus comprising a more simple sheet holding mechanism and superior in the reliability of setting a new sheet to the apparatus.

SUMMARY OF THE INVENTION

For solving aforementioned object, the sheet splicing apparatus of this invention comprises a sheet holding bar which is arranged along the width of the end portion of the sheet from the secondary roll. The end portion of the sheet is removably attached to the sheet holding bar which moves in this state between a position for attaching the end portion of the sheet and a position for splicing it to the sheet from the primary roll. On the sheet holding bar, a plurality of holding pins are removably mounted at an arbitrary distance along the width of the sheet. These holding pins hold the sheet by piercing through the sheet in the thickness direction thereof and have a sheet stopping portion for preventing the sheet dropping off from the holding pin, respectively.

According to the constitution mentioned above, the end portion of the sheet from the secondary roll is pierced and held by holding pins mounted on the holding bar, and each pin has a sheet stopping portion for preventing the sheet dropping off, so that the reliability of sheet holding improves. Since the pins are removably mounted on the sheet holding bar, broken or worn pins can be easily replaced with new ones. Furthermore, the sheet holding mechanism fundamentally comprises only two elements, i.e., a sheet holding bar and a plurality of sheet holding pins, so that the structure of the mechanism becomes very simple, and the cost of apparatus can be reduced.

Each of the holding pins may have a threaded portion on the side mounted to the sheet holding bar. The threaded portion is screwed into a tapped hole formed on the sheet holding bar. This constitution makes the mounting and dismounting of the pins against the sheet holding bar easy. For a convenience of screwing the threaded portion into the tapped hole, tool engaging portions are preferably formed on both sides according to the axial direction of the holding pin. More specifically, these tool engaging portions may be two planer portions formed almost parallel each other on the outer surface of the holding pin.

For reliable mounting of the pin on the holding bar, a lock nut may be screwed on the part of the threaded portion out of the tapped hole. It is fastened toward the sheet holding bar thereby preventing the threaded portion unscrewing from the tapped hole. On the other hand, holding pin can be adjusted for the length projected from the tapped hole by changing the screwing amount of the threaded portion in the tapped hole. According to this constitution, the length of the projected part of the pin can be adjusted corresponding to, for example, the material or the thickness of the sheet, so that an excellent reliability of sheet holding is achieved over wide variety of the sheet. In this case, the lock nut secures the connection between the pin and the holding bar according to an adjustment of its location on the threaded portion corresponding to the projecting length of the pin from the tapped hole.

the holding pin can be constituted as the one comprising a piercing tip portion which is formed sharply for piercing through the sheet, and a sheet stopping portion, which is formed on the intermediate portion of the holding pin in the axial direction thereof. The summit part of the piercing tip portion is preferably formed as a planar or curved surface for avoiding an excess sharpness.

A more specific constitution of the holding pin comprises a pin head having a triangular cross section in the axial direction thereof and a pin shaft which is integrated with the pin head as extending from the bottom thereof. In this case, the pin shaft has a smaller sectional area than the bottom of the pin head. The summit portion of the pin head functions as the piercing tip portion, and the bottom portion thereof functions as the sheet stopping portion. The holding pin of this constitution is effective for piercing and holding the sheet and easy for manufacture. In this case, the threaded portion can be formed on the pin shaft. Furthermore, the pin head may have two planer portions formed almost parallel each other on the outer surface of the bottom portion thereof, as the tool engaging portions.

The tip angle of the pin head is preferably adjusted in a range of 50–70 degress. A tip angle less than 50 degrees leads to an excess length of the pin, and that more than 70 degrees may cause insufficiency of piercing ability.

On the other hand, the width of the bottom plane of the pin head, B, and that the cross section of the pin shaft, A, are preferably provided so that the ratio of B/A is in a range of 1.5–3. B/A less than 1.5 may make the sheet holding ability of the pin head insufficient, and that more than 3 may obstruct a smooth removal of the sheet from the pin head thereby damaging the sheet.

Furthermore, the axial length of the pin head, LH, and that of the portion of the pin shaft projected from the surface of the sheet holding bar, LA, are preferably provided so that the ratio of LH/LA is in a range of 0.2–2. When LH/LA is set to a value out of the range indicated above, the sheet holding ability may become insufficient.

This invention also offers a sheet attaching tool for setting the end portion of the sheet to the sheet holding bar. Specifically, the tool comprises a rolling portion which rolls on the end portion of the sheet located on the sheet holding bar along the direction of the width of the sheet and allows the sheet holding pin entering into itself and leaving therefrom, and a holder for holding the rolling portion rotatively. The rolling portion urges the sheet to the sheet holding pins mounted on the sheet holding bar thereby making the pins sequentially pierce through the sheet, accepts the entrance of the pins piercing through the sheet, and allows the leaving of the in, as the rolling movement of the rolling portion proceeds.

According to the tool described above, the rolling portion rolls on the end portion of the sheet avoiding the interference with the pins since the pins can enter into the rolling portion, so that the sheet can be attached easily to the sheet holding bar.

A more specific constitution of the rolling portion comprises a shaft for the rotation of the rolling portion, and a plurality of circular rolling elements which are arranged on the shaft at an arbitrary distance and allowed to displace elastically along the axial direction of the shaft. The holding pins are to enter into and leave from the spacings formed between the rolling elements. The rolling elements displace elastically along the shaft for allowing the pins entering into the spacings if an interference between the pins and rolling elements occurs, so that the sheet attaching to the holding bar can be performed more smoothly.

Furthermore, the plurality of circular rolling elements are preferably formed continuously as a coil spring, whereby the structure of the rolling body becomes simple. The holding pins enter into and leave from a spiral spacing formed in the coil spring. In this case, aforementioned holder can be constituted so as to comprise a holding plates arranged on both sides of the coil spring in its axial direction, and stoppers formed on the shaft outside the holding plates. The shaft passes through the holding plates and coil springs, and supports them rotatively.

BRIEF DESCRIPTION OF DRAWINGS

In the accompanying drawings:

FIGS. 10*a* and 10*b* are sectional views presenting the function of the sheet holding bars;

FIG. 12*a* is a figure presenting another embodiment of the sheet holding bars along with FIGS. 12*b* and 12*c* showing the function thereof;

DETAILED DESCRIPTION OF THE PREFERABLE EMBODIMENTS

Several embodiments of this invention will now be described with reference to drawings.

Figures 1A, 1B:
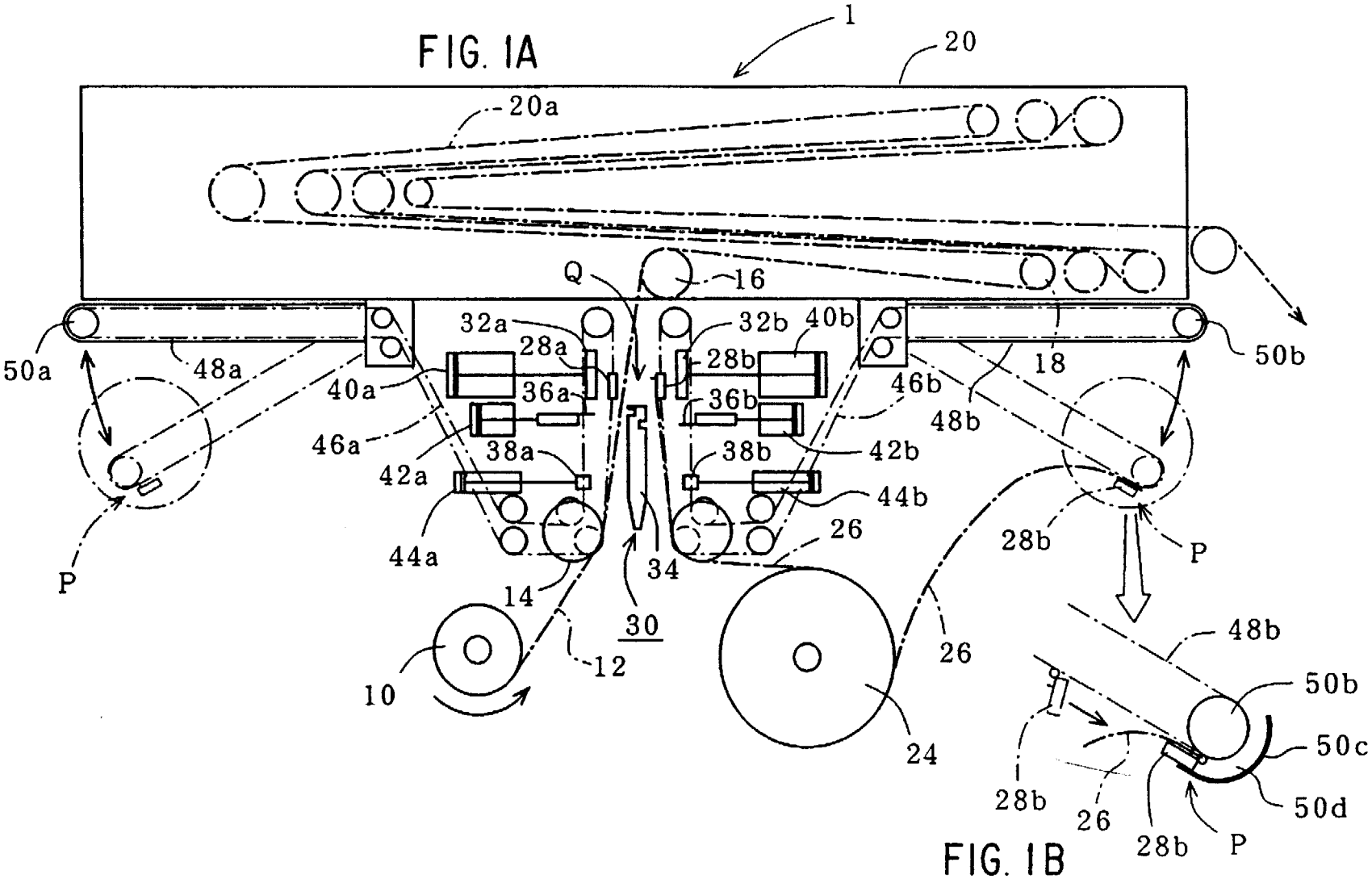
FIG. 1 is a front view schematically representing an embodiment of the sheet splicing apparatus relating to this invention.

As shown in FIG. 1, in the sheet splicing apparatus (which will be called merely as "splicer" hereinafter) 1 regarding one of embodiments of this invention, the sheet 12 from the primary roll (old roll) 10 is fed to a line for manufacturing corrugated plate (not presented in the figure) via guide rollers 14, 16, 18 and a festoon 20, which absorbs the difference in the sheet feeding rate between the upstream and the downstream thereof during the sheet splicing step. On the other hand, the secondary roll (new roll) 24 is standing by for the splicing step in a state of stopping its rotation. The end portion of the sheet 26 withdrawn from the secondary roll 24 is attached on the sheet holding bar (which will be called merely as "holding bar" hereinafter) 28*b* located in the setting position (attaching position) P.

As is shown in FIG. 1, the splicer 1 has a splicing head 30 in the central section thereof. In the upper portion of the splicing head 30, a pair of upper nipping bars 32*a*, 32*b* are mounted as opposed to each other, and a knife back up bar 34 is fixedly arranged thereunder. Furthermore, a pair of knives 36*a*, 36*b* and lower nipping bars 38*a*, 38*b* are provided facing each other with the knife back up bar 34 between, respectively. Each nipping bar 32 and knife 36 in the pairs are driven synchronously or selectively in the direction moving to and away from each other by means of air cylinders 40*a*, 40*b*, 42*a*, 42*b*, 44*a*,and 44*b*, respectively.

In the gap formed between the pair of upper nipping bars 32*a*, 32*b* (where the splicing position Q is defined), a pair of sheet holding bars 28*a*, 28*b* are arranged facing to each other and circulate independently along endless paths provided by chains 46*a*, 46*b*which support the sheet holding bars 28*a*, 28*b*, respectively. The chains 46*a*, 46*b* transport the sheet holding bars 28*a*, 28*b* between the splicing position Q and the setting position P which locate in the end portion of swing arms 48*a*, 48*b*, and whereat the end portion of the sheet from a new roll is attached to the sheet holding bars 28*a* and 28*b*, respectively.

In this embodiment, each sheet holding bar 28 is rotatively supported by the chain 46 at one edge thereof. A sprocket wheel 50*b* for the circulation of the chain 46 is mounted rotatively at the end portion of the swing arm 48, corresponding to the setting position P. A guide portion 50*c* is arranged corresponding to the circumference of the sprocket wheel 50b at the state of allowing the chain 46 entering into the gap formed between the sprocket wheel 50b and a guide portion 50c, along with the sheet holding bar 28. The setting position is defined at the entrance of the gap, and the sheet holding bar 28 is held thereat lying toward the chain 46. In this state, the sheet is to be set to the bar 28.

Figure 2:
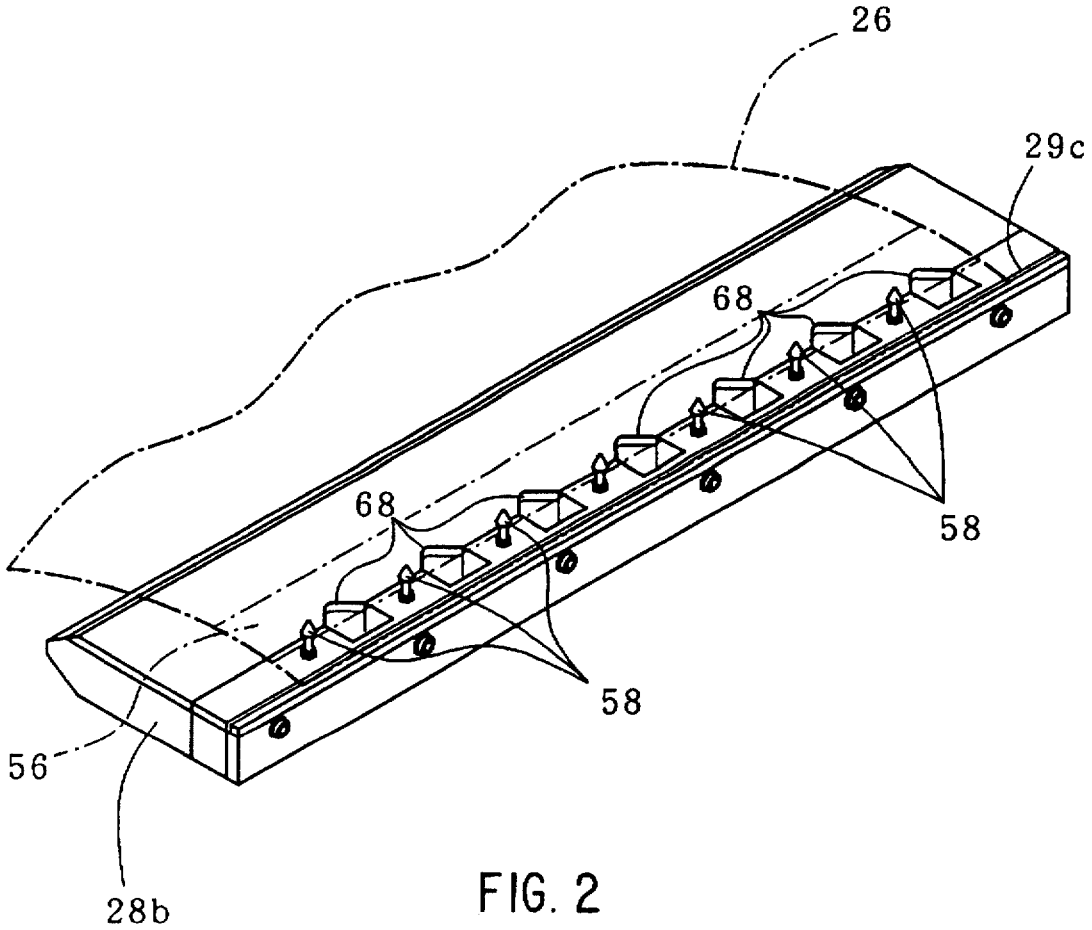
FIG. 2 is a perspective view of a sheet holding bar.
Figure 3A:
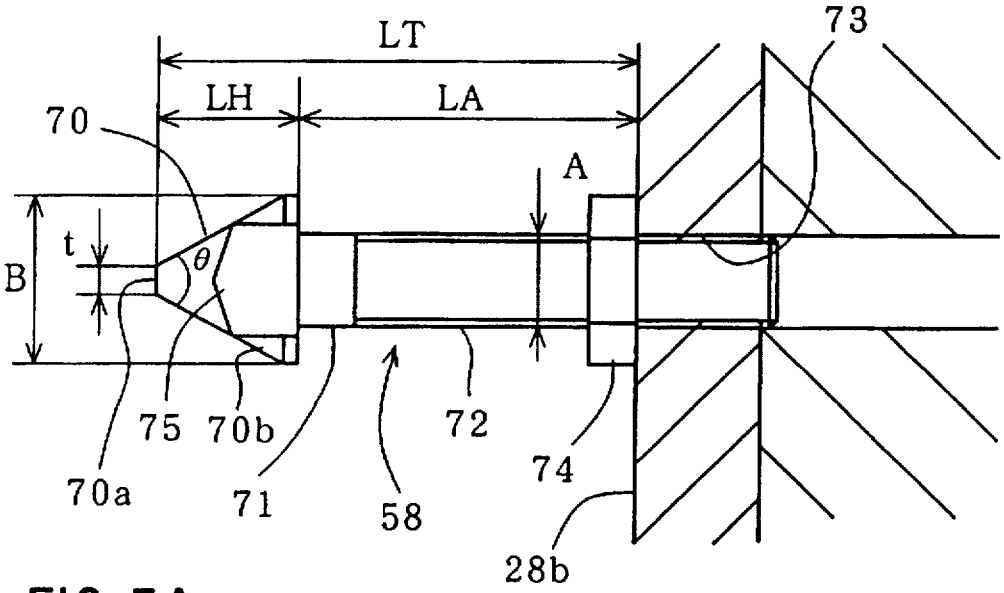
FIGS. 3*a*, 3*b*, and 3*c* are front views of a sheet holding pin.
Figure 3B:
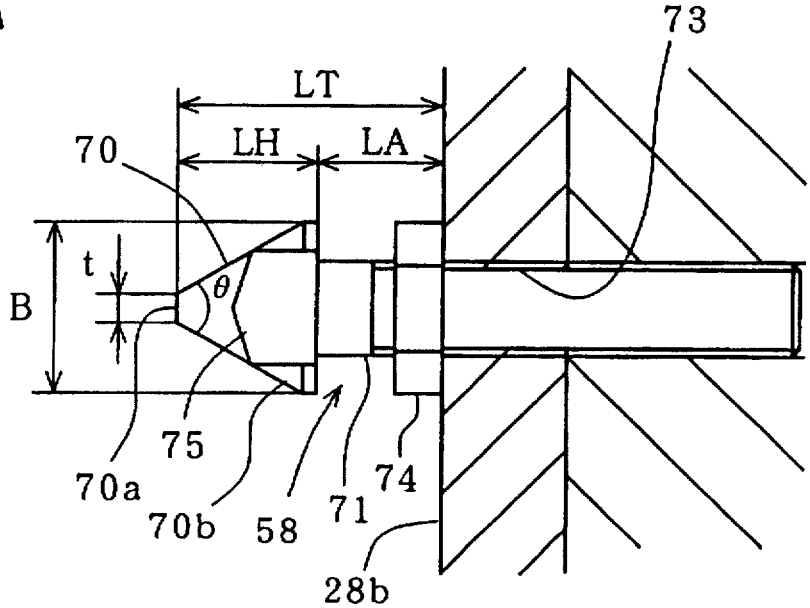
Figure 3C:
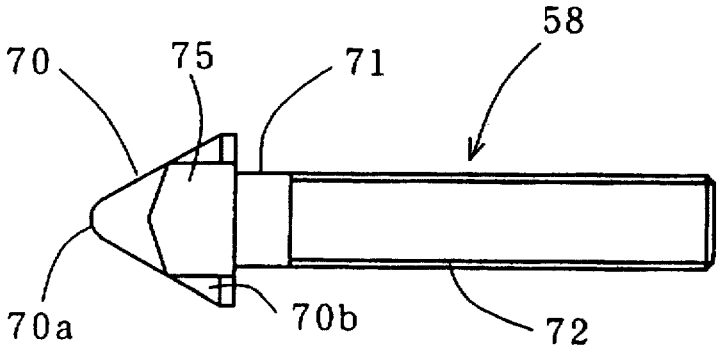

As shown in FIG. 2, a plurality of holding pins 58 are removably mounted on each sheet holding bar (represented by 28b, hereinafter) at an arbitrary distance along the width of the sheet 26. As shown in FIG. 3 (*a*), each holding pin 58 has a pin head 70 and a pin shaft 71. The pin head 70 is formed in a shape having a triangular cross section in the axial direction thereof, such as a conical shape. The summit part 70a of the pin head 7 is to function as a piercing tip portion for piercing through the sheet 26, and is formed in a planar surface for avoiding an excess sharpness. This summit part 70a can be formed as a curved surface as shown in FIG. 3 (*c*). The width t of the summit part 70a is preferably chosen in a range of 0.1–0.7 mm. On the other hand, the pin shaft 71 extends from the bottom of the pin head 70 forming an integral part with the pin head 70. The bottom portion 70b of the pin head 70 has larger sectional area than the pin shaft 71 thereby functioning as a sheet stopping portion for preventing the pierced sheet 26 dropping off from the pin head 70.

The pin shaft 71 has a threaded portion 72 on the side to be mounted to the sheet holding bar 28b. This threaded portion 72 is screwed into a tapped hole 73 formed on the sheet holding bar 28b thereby mounting the holding pin 58 removably to the sheet holding bar 28b. Furthermore, a lock nut 74 is screwed on the part of the threaded portion 72 out of the tapped hole 73 and fastened toward the sheet holding bar 28b thereby preventing the threaded portion 72 unscrewing from the tapped hole 73. The holding pin 58 can be adjusted for the length LT projected from the tapped hole 73 by changing the screwing amount of the threaded portion 72 into the tapped hole 73, as shown in FIG. 3 (*b*). The position of the lock nut 74 is adjusted corresponding to the projecting length LT.

The length LT can be differed independently for each pin 58. Furthermore, the pins 58 may be mounted on the sheet holding bar 28a inclined to the surface thereof by using an inclined tapped hole 73. The pins 58 mounted inclined in the direction toward the end of the sheet 26 may prevent the sheet 26 dropping off from the pins 58 more effectively.

The pin head 70 has a tip angle θ in a range of 50–70 degrees. The width of the bottom plane of the pin head 70, B, and that of the cross section of the pin shaft 71, A, are provided so that the ratio of B/A is in a range of 1.5–3. Furthermore, the axial length of the pin head 70, LH, and that of the portion of the pin shaft 71 projected from the surface of the sheet holding bar 28b, LA, are provided so that the ratio of LH/LA is in a range of 0.2–2.

Figure 4A:
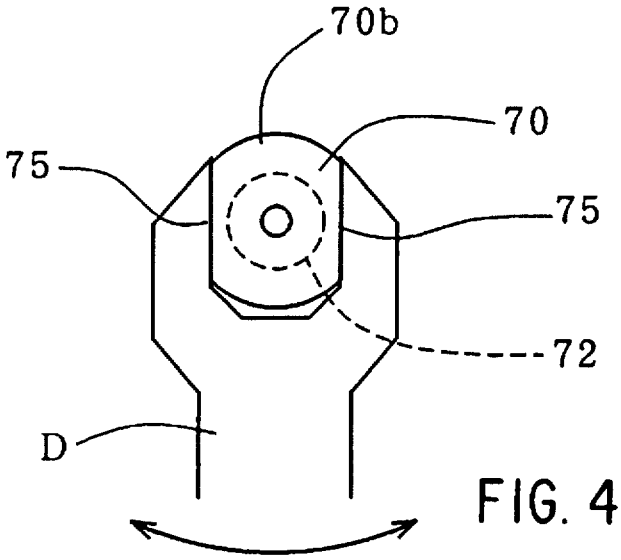
FIGS. 4*a* and 4*b* are figures explaining the function of the tool engaging portion of the sheet holding pin.
Figure 4B:
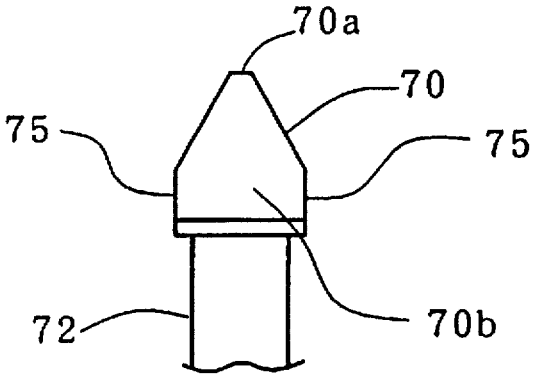

As shown in FIG. 4. (*a*) and (*b*), the pin head 70 has two planar portions 75 formed almost parallel each other on the outer surface of the bottom portion 70b. These planar portions 75 function as tool engaging portions with which a tool D for screwing the threaded portion 72 into the tapped hole 73 is to engage. The circumferential portion of the bottom portion 70b is chamfered for avoiding excess sharpness.

Now, the operation of the splicer 1 is going to be explained in the following. As shown in FIG. 1, the sheet holding bar 28 is transported to the setting position P and stands by for the setting of the sheet 26. The end portion of the sheet 26 is located on the sheet holding bar 28b along the direction of the width thereof over the holding pins 58. The sheet 26 is to be set against the holding bar 28b by urging the sheet 26 to the holding pins 58 with hand or, for example, the following sheet attaching tool 80 presented in FIG. 5.

Figure 5A:
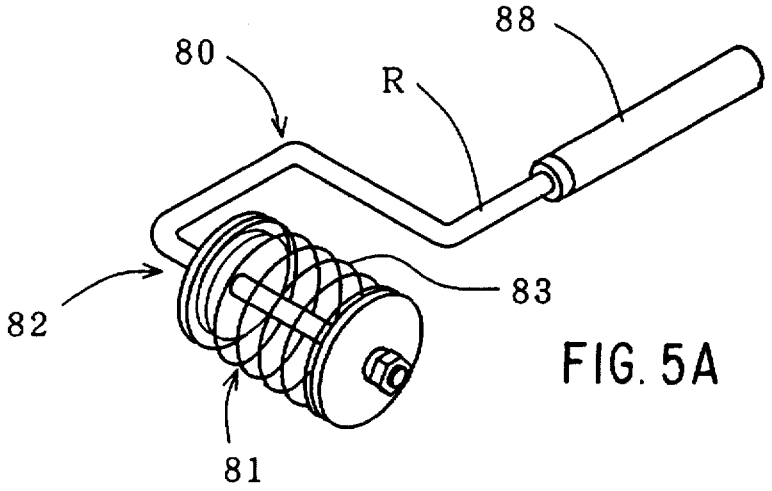
FIGS. 5*a* presents a perspective view of the sheet attaching tool and FIGS. 5*b* and 5*c* are front views of the rolling portion thereof.
Figure 5B:
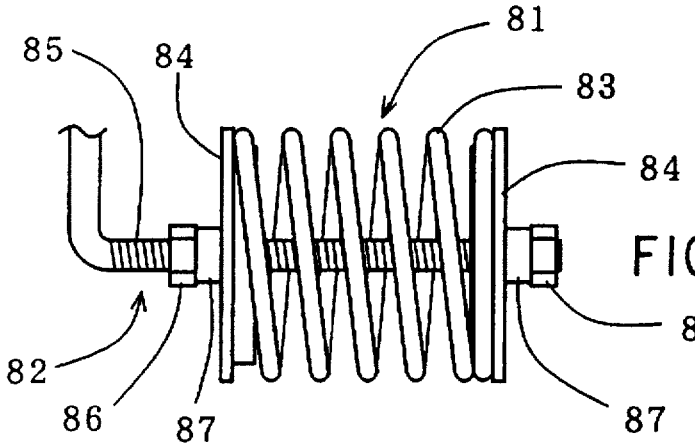
Figure 5C:
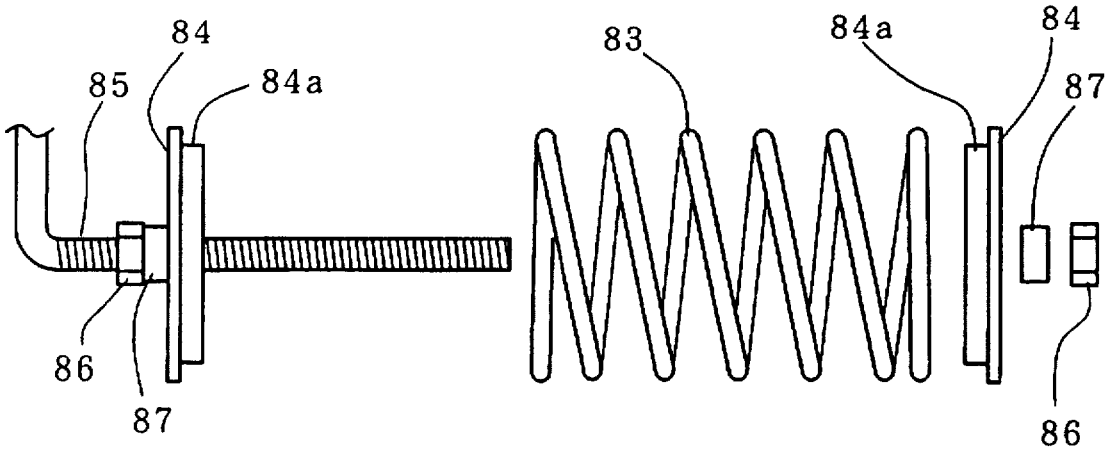

The sheet attaching tool 80 comprises a rolling portion 81 and a holder 82 for holding rotatively the rolling portion 81, as shown in FIG. 5 (*a*). The rolling portion 81 is fundamentally formed by a coil spring 83. As shown in FIG. 5 (*b*), holding plates 84 are arranged on both sides of the coil spring 83 in its axial direction, and a threaded supporting shaft 85 passes through the holding plates 84 and the coil spring 83. Furthermore, nuts 86 as stoppers are screwed on the supporting shaft 85 from outside of the holding plates 84. Between each nut 86 and holding plate 84, a collar 87 are inserted for assisting the rotation of the coil spring 83 along with the holding plates 84. In this embodiment, the supporting shaft 85 is formed on one end portion of a rod R, whose relating side is bent in a C-shape as shown in FIG. 5 (*a*). A grip 88 for handling the tool 80 is mounted on the other end portion of the rod R.

Each part of the tool 80 are assembled in the way presented in FIG. 5 (*c*), i.e., one of the nuts 86 is screwed on the supporting shaft 85, and subsequently the corresponding collar 87 and the holding plate 84 are inserted thereto. Each holding plate 84 has a guide portion 84a, which is formed along the circumferential portion of the plate 84 on the side facing to the coil spring 83, and which is engaged into the coil spring 83 just fitting inside thereof. The coil spring 83 is set against the holding plate 84, and the other plate 84 and collar 87 are inserted to the supporting shaft 85 with compressing the coil spring 83. Then, the rest of the nut 86 is screwed on the shaft 85 thereby holding the coil spring 83 in a compressed state between the two holding plates 84. The amount of compression of the coil spring 83 can be adjusted by changing the position of the nut 86 on the shaft 85.

Figure 6A:
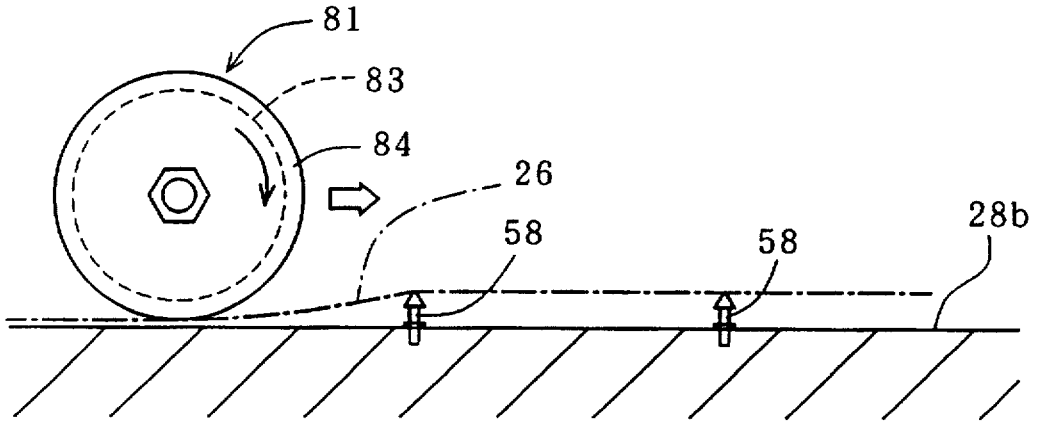
FIG. 6*c* presents an elevation and FIGS. 6*a* and 6*b* are side views of the rolling portion.
Figure 6B:
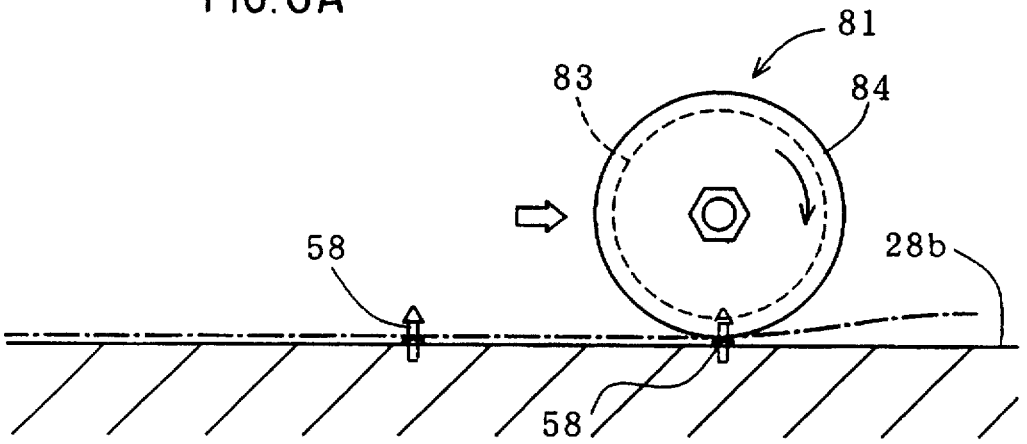
Figure 6C:
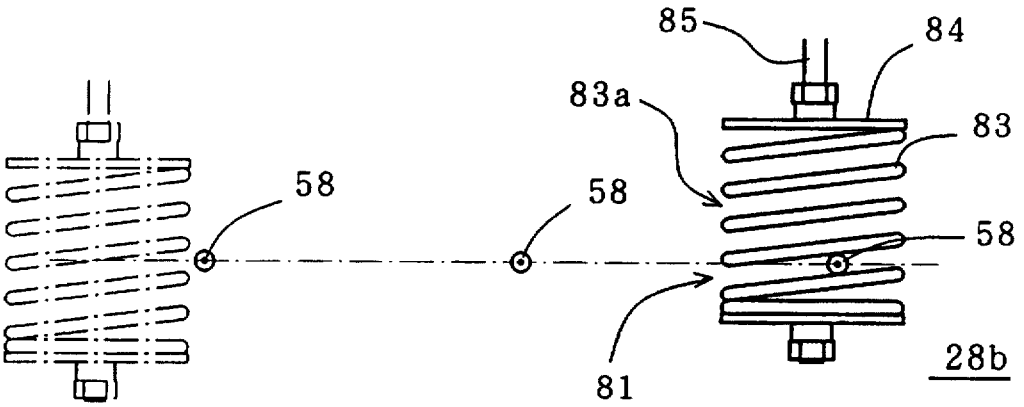
Figure 7:
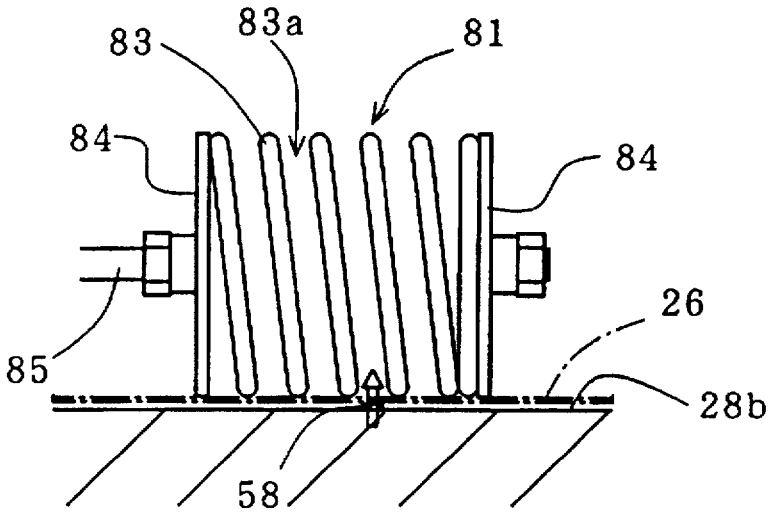
FIG. 7 is a figure explaining the function of the rolling portion.

Holding the grip 88 (FIG. 5 (*a*)), the operator rolls the rolling portion 81 on the end portion of the sheet 26 located against the sheet holding bar 28b, as shown in FIG. 6 (*a*). The coil spring 83 allows the sheet holding pin 58 entering into and leaving from a spiral spacing 83a formed therein as shown in FIG. 6 (*c*) and FIG. 7. As the rolling proceeds, the rolling portion 81 urges the sheet 26 to the sheet holding pins 58 mounted on the sheet holding bar 28b thereby making the pins 58 sequentially pierce through the sheet 26, and accepts the entrance of the pins 58 piercing through the sheet 26 as shown in FIG. 6 (*b*) and FIG. 7. The pins 58 piercing through the sheet 26 are left one by one along with the rolling of the coil spring 83. If an interference between the pins 58 and the coil spring 83 occurs, the respective turn of the coil spring 83 may elastically displace along the shaft 85 thereby allowing the pins 58 entering into the spiral spacing 83a.

Figure 13A:
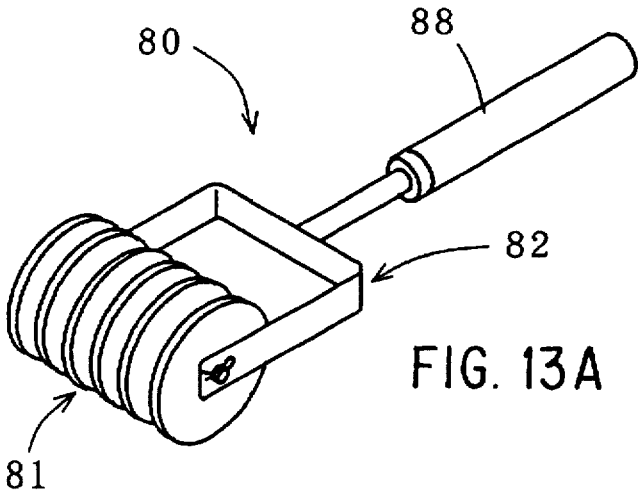
FIGS. 13*a* and 13*b* a perspective view and a front view of another embodiment of the sheet attaching tool respectively.
Figure 13B:
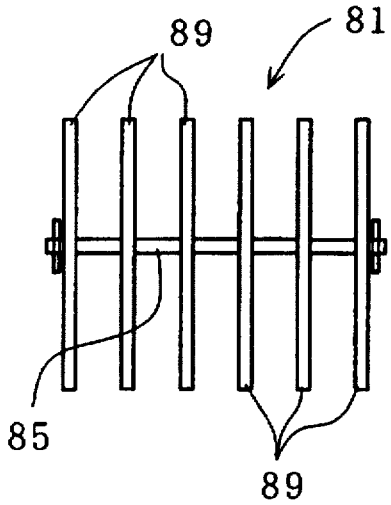

FIG. 13 shows another embodiment of the tool 80. The tool 80 comprises a rolling portion 81 wherein a plurality of rolling elements 89 are arranged on a shaft 85 at a designated distance. Each rolling element 89 is formed in a disk-like shape and integrated with the shaft 85 by means of an injection molding of plastics, thereby allowed to elastically displaces along the shaft 85. The holder 82 has a fork-like shape and supports the shaft 85 rotatively at each end thereof. The pins 58 are to enter into the spacings formed between the rolling elements.

Thus, the sheet 26 is attached to the holding bar 28b being pierced with the holding pins 58 as shown in FIG. 2. The pierced sheet 26 is caught by the bottom portion 70b (FIG. 3) of each pin head 70 thereby prevented to drop off from the pins 58. The edge of the end portion of the attached sheet 26 is cut by a cutter (not presented in the figure) along the cutter guiding groove 29*c*, and a double-faced adhesive tape 56 is attached on the surface of the sheet 26 in front of the pins 58 (an adhesive layer is exposed at the upper side of the adhesive tape 56).

Then, as shown in FIG. 1, the chain 46*b* is driven for transporting the sheet holding bar 28*b* to the splicing position Q between the upper nipping bars 32*a* and 32*b* along with the sheet 26. At this time, the counter sheet holding bar 28*a* is also transported to the splicing position Q thereby facing to the holding bar 28*b* with the sheet 12 from the first roll 10 and the transported sheet 26 from the secondary roll 24 between.

Figure 8:
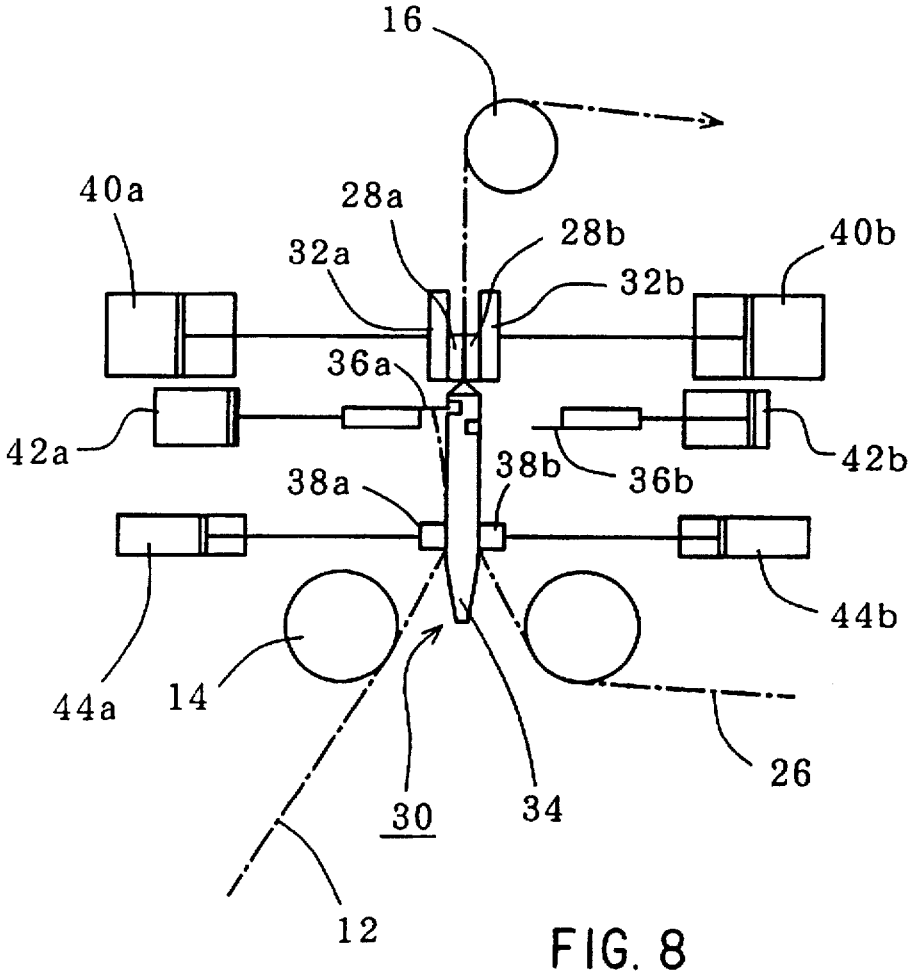
FIG. 8 is a schematic view presenting the function of the splicing head.

At the timing that the sheet splicing is required, such as of the sheet in the primary roll 10 being depleted or the standard of the sheet being changed, a control unit (not presented in the figure) generates a splicing signal. According to this signal, as shown in FIG. 8, the rotation of the primary roll 10 is stopped, and the cylinders 40*a*, 40*b* and 44*a*, 44*b* are activated, respectively, whereby the upper and lower nipping bars 32*a*, 32*b* and 38*a*, 38*b* move to each other, respectively. The upper nipping bars 32*a*, 32*b* urge the holding bars 28*a*, 28*b* while the lower nipping bars 38*a*, 38*b* hold the sheets 12 and 26, respectively, with the knife back up bar 34. Thus, the sheets 12 and 26 are clipped between the holding bars 28*a* and 28*b* and spliced by the double-faced adhesive tape 56. During the splicing, the sheet 20*a* stored in the festoon 20 (FIG. 1) is to be consumed for maintaining the continuous sheet feeding to the downstream line.

Figure 9A:
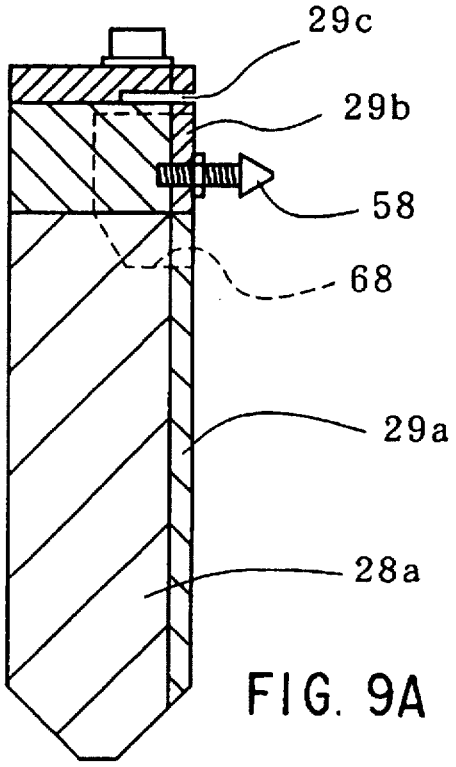
FIGS. 9*a* and 9*b* present a sectional view and a partial side view of the sheet holding bar respectively.
Figure 9B:
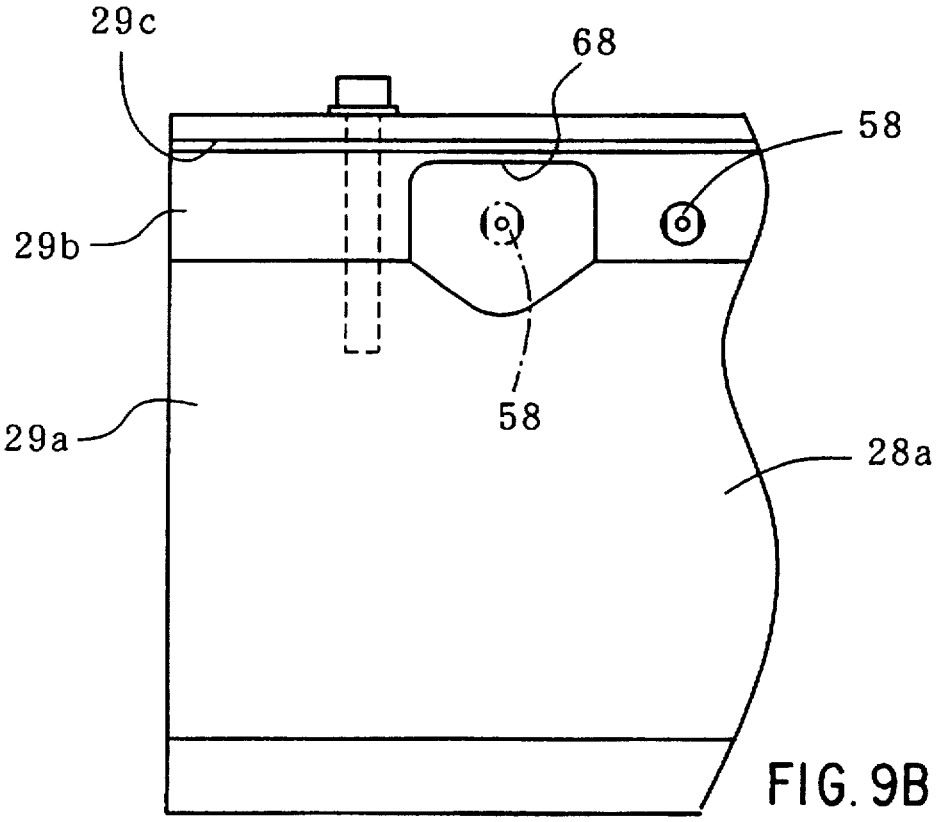

As shown in FIG. 2 and FIG. 9, for avoiding the interference between the holding pins 58 and the counter holding bar 28 during the splicing step, recesses 68 are formed on each bar 28 at the intervals formed between the pins 58. The pins 58 and recesses 68 of the bars 28*a*, 28*b* are arranged alternately with each other, and each pin 58 enters into the corresponding recess 68 of the counter bar during nipping as shown in FIG. 10. In FIG. 9 (*b*), each recess 68 has a pentagonal cross section though, it may be formed also in a circular or an elongated circular shape. Furthermore, the recess 68 can be formed not only as a blind hole, but also as a through hole.

As shown in FIG. 1, after nipping the sheets 12 and 26 for splicing, the knife 36*a* is activated toward the knife back up bar 34 by the cylinder 42*a* and cuts the sheet 12 from the primary roll 10, and then the secondary roll 24 starts to rotate and feed the sheet 26 to the line, while the residual primary roll 10 is exchanged with a new one, which is to stand by for next splicing.

Instead of using a pair of sheet holding bars 28*a* and 28*b*, the sheet may be held by one holding bar 28 with holding pins 58, and the recesses 68 may be formed on the counter upper nipping bar 32. In this case, the sheets 12 and 26 are to be nipped between the holding bar 28 and the upper nipping bar 32.

Figure 11A:
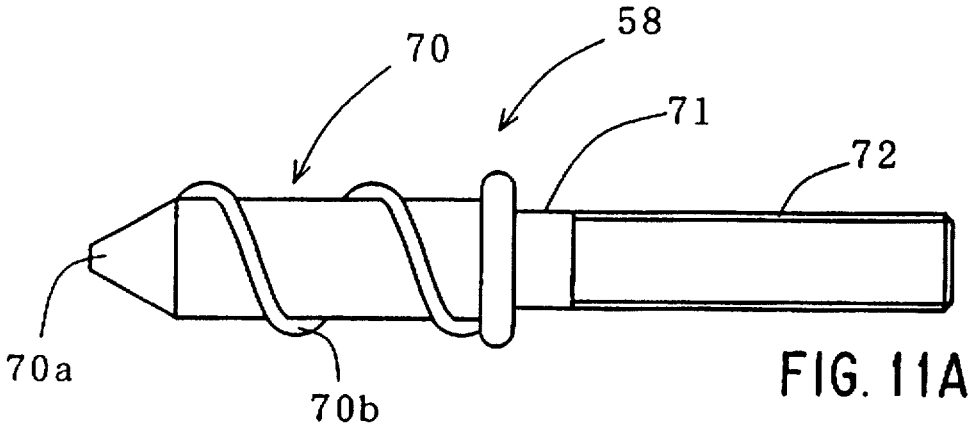
FIGS. 11*a* and 11*b* are front views presenting other embodiments of the sheet holding pins.
Figure 11B:
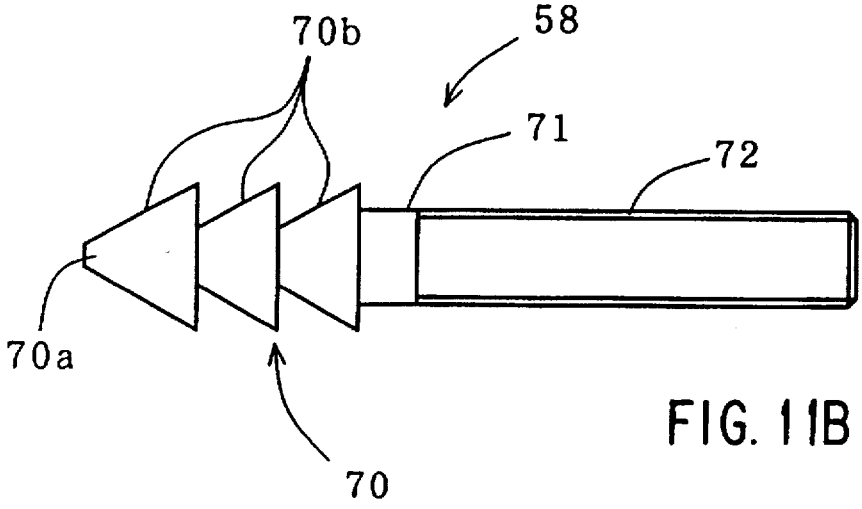

FIG. 11 presents several modifications of the holding pin 58. The pin 58 in FIG. 11 (*a*) has a helical stopping portion 70*b* on the side surface of the pin head 70. On the other hand, the pin 58 in FIG. 11 (*b*) has a pin head 70 having a plurality of conical stopping portion 70*b*, which are arranged along the axial direction of the pin shaft 71.

In the embodiment presented in FIG. 10, the sheet 26 is pierced by the pin 58 at the band-like portion 26*b* formed between the sheet edge 26*c* and the attached adhesive tape 56. After the splicing step, this bank-like portion 26*b* becomes a useless tale portion 90 projects from the tape 56 to the downstream side, and may lead to as trouble in the line in some cases. For preventing such problem, it is effective that the holding pin 58 be mounted on the sheet holding bar 28*b* so that a space for attaching a double-faced adhesive tape 56 be provided at the area of the sheet 26 between the sheet edge 26*c* and the pin 58, as presented in FIG. 12 (*a*). According to this constitution, the tape 58 can be attached just near the sheet edge 26*c*, and the tale portion 90 becomes very short.

Figure 14:
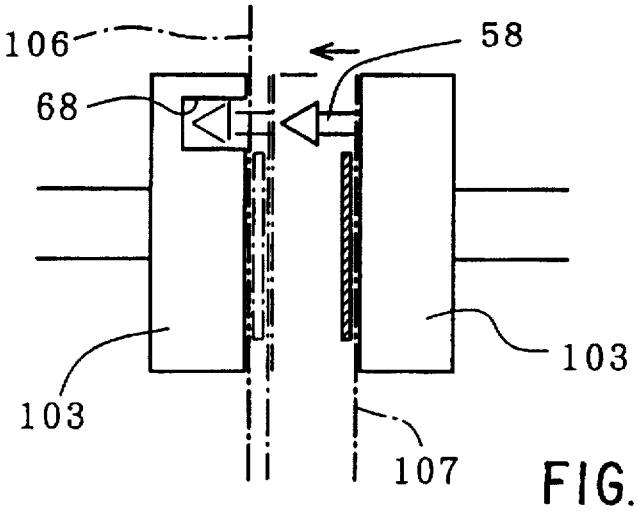
FIG. 14 is an enlarged front view of the splicing heads for another embodiment of the sheet splicing apparatus.
Figure 15:
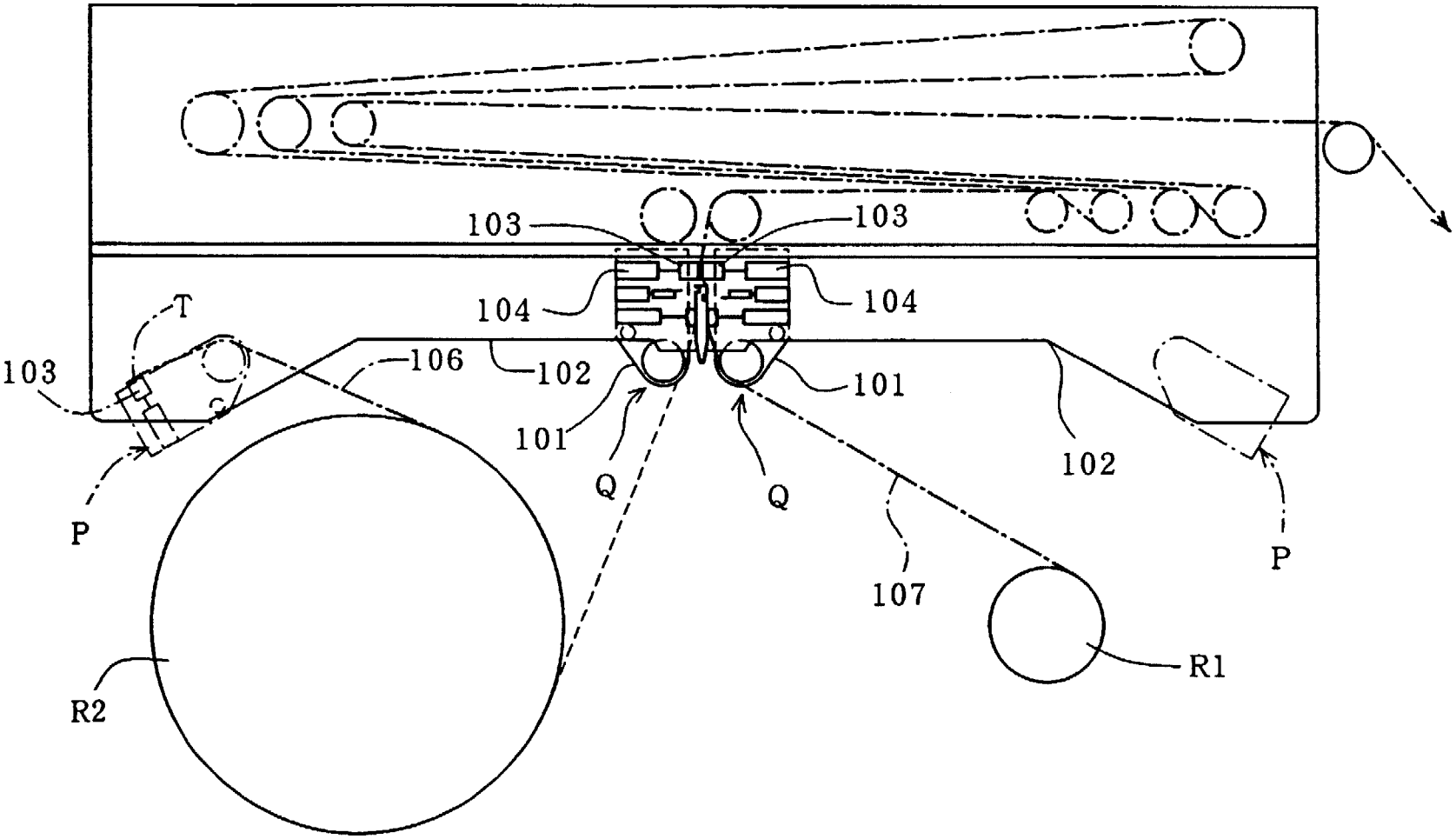
FIG. 15 PRIOR ART
FIG. 15 is a schematic front view of a conventional splicing apparatus.
Figure 16:
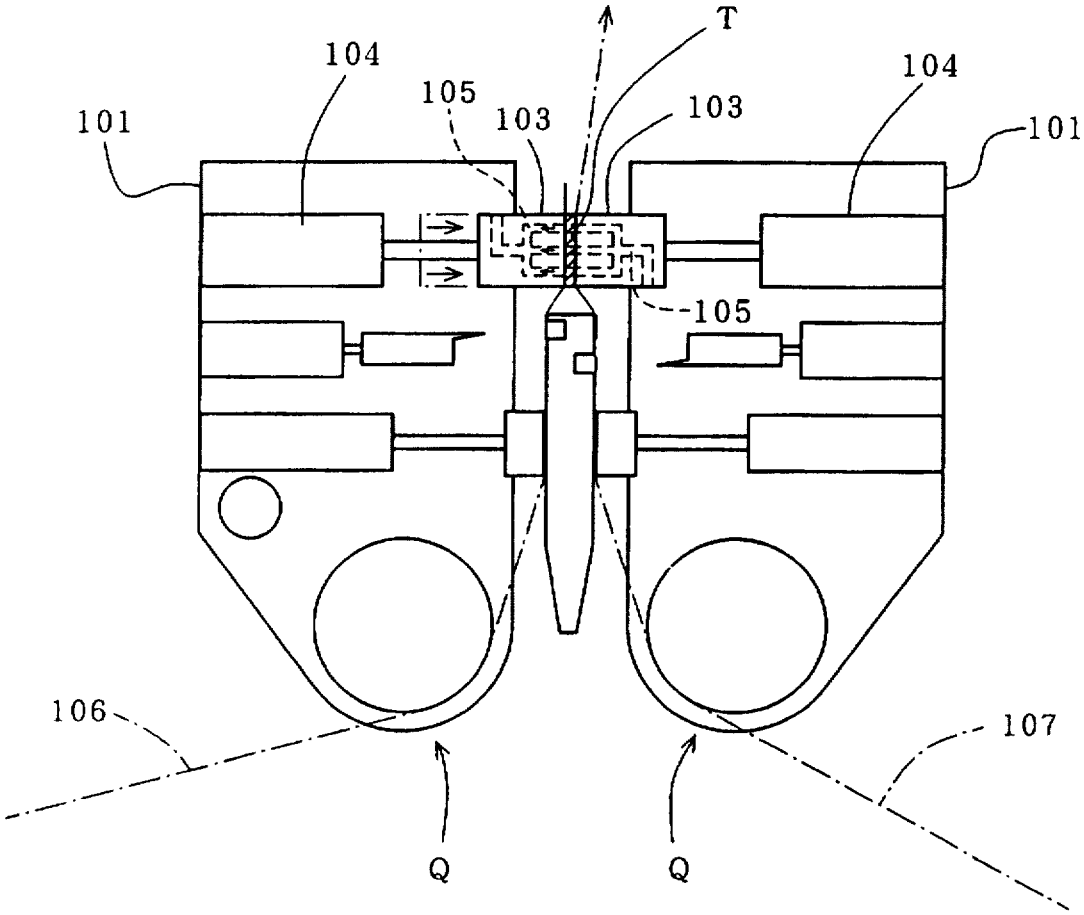
FIG. 16 PRIOR ART
FIG. 16 is an enlarged front view of the splicing heads thereof.

On the other hand, the sheet splicing apparatus 100 presented in FIG. 15 and FIG. 16 can be constituted as the one comprising nipping bars 103 on which a plurality of sheet holding pins 58 and recesses 68 instead of a suction mechanism 105 as shown in FIG. 14. The end portion of the sheet 106 from the new roll R2 is attached to one of the nipping bars 103 at the setting position P by using the holding pins 58. The nipping bar 103 holding the sheet 106 is to move along with the splicing head 101 to the splicing position Q. In this embodiment, the nipping bars 103 function also as sheet holding bars.

That which is claimed is:

1. A sheet splicing apparatus for splicing a first sheet from a primary roll to a second sheet from a secondary roll;

wherein said sheet splicing apparatus comprises a sheet holding bar which is arranged along the width of an end portion of the second sheet, and said end portion of the second sheet is removably attached to said sheet holding bar, wherein said sheet holding bar moves between a position for attaching said end portion of the second sheet and a position for splicing said end portion to the first sheet from said primary roll while removably holding the second sheet; and wherein a plurality of holding pins, which hold said second sheet by piercing through said second sheet in the thickness direction thereof and have a sheet stopping portion for preventing said second sheet from dropping off said holding pins, are removably mounted on said sheet holding bar along the width of said sheet.

2. A sheet splicing apparatus according to claim 1, wherein each of said holding pins has a threaded portion on the side mounted to said sheet holding bar, and said threaded portion is screwed into a tapped hole formed in said sheet holding bar, thereby removably mounting said holding pin to said sheet holding bar.

3. A sheet splicing apparatus according to claim 2, wherein each of said holding pins has tool engaging portions which are formed on two radially opposite sides of said holding pins, and with which a tool can engage for screwing said threaded portion into said tapped hole.

4. A sheet splicing apparatus according to claim 3, wherein said tool engaging portions are two planar portions formed substantially parallel to each other on the outer surface of said holding pin.

5. A sheet splicing apparatus according to claim 2, wherein a lock nut is screwed on a part of said threaded portion outside of said tapped hole and fastened toward said sheet holding bar thereby preventing said holding pin unscrewing from said tapped hole.

6. A sheet splicing apparatus according to claim 5, wherein said holding pin can be adjusted for the length projected from said tapped hole by changing the screwing amount of said threaded portion in said tapped hole, and wherein the location of said lock nut on said threaded portion is adjusted corresponding to the projecting length of said holding pin from said tapped hole.

7. A sheet splicing apparatus according to claim 1, wherein said holding pin comprises:

a sharp piercing tip portion for piercing through said sheet; and said sheet stopping portion which is formed on an intermediate portion of said holding pin in the axial direction thereof and has a larger sectional area than the portion adjacent thereto.

8. A sheet splicing apparatus according to claim 7, wherein a summit part of said piercing tip portion is blunt.

9. A sheet splicing apparatus according to claim 7, wherein said holding pin comprises:

a pin head, which has a triangular cross section in the axial direction thereof, wherein the summit portion thereof functions as said piercing tip portion, and wherein the bottom portion thereof functions as said sheet stopping portion; and a pin shaft which extends from the bottom of said pin head and which has a smaller sectional area than said bottom of said pin head.

10. A sheet splicing apparatus according to claim 9, wherein said pin shaft has a threaded portion on the side mounted to said sheet holding bar, and said threaded portion is screwed into a tapped hole formed in said sheet holding bar, thereby removably mounting said holding pin to said sheet holding bar.

11. A sheet splicing apparatus according to claim 10, wherein a lock nut is screwed on a part of said threaded portion outside of said tapped hole and fastened toward said sheet holding bar thereby preventing said holding pin unscrewing from said tapped hole.

12. A sheet splicing apparatus according to claim 11, wherein said holding pin can be adjusted for the length projected from said tapped hole by changing the screwing amount of said threaded portion in said tapped hole, and wherein the position of said lock nut is adjusted corresponding to the projecting length of said holding pin from said tapped hole.

13. A sheet splicing apparatus according to claim 10, wherein said pin head has two planar portions formed substantially parallel to each other on an outer surface of the bottom portion thereof, wherein said planar portions function as tool engaging portions with which a tool can engage for screwing said threaded portion into said tapped hole.

14. A sheet splicing apparatus according to claim 11, wherein said pin head has a tip angle in a range of 50–70 degrees.

15. A sheet splicing apparatus according to claim 11, wherein the width of the bottom portion of said pin head, B, and the cross section of said pin shaft, A, are provided in a ratio of B/A in a range of 1.5–3.

16. A sheet splicing apparatus according to claim 11, wherein an axial length of said pin head, LH, and an axial length of a portion of said pin shaft projected from the surface of said sheet holding bar, LA, are provided in a ratio of LH/LA in a range of 0.2–2.

* * * * *